US008267729B2

(12) United States Patent
Yamashita et al.

(10) Patent No.: US 8,267,729 B2
(45) Date of Patent: Sep. 18, 2012

(54) SOCKET CONTACT

(75) Inventors: Masaki Yamashita, Tokyo (JP); Kazuhito Hisamatsu, Tokyo (JP); Yosuke Honda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 442 days.

(21) Appl. No.: 12/589,452

(22) Filed: Oct. 23, 2009

(65) Prior Publication Data

US 2010/0167598 A1 Jul. 1, 2010

(30) Foreign Application Priority Data

Dec. 26, 2008 (JP) ..... 2008-332901

(51) Int. Cl.
*H01R 13/42* (2006.01)

(52) U.S. Cl. ..... 439/751; 439/857

(58) Field of Classification Search ..... None
See application file for complete search history.

(56) References Cited

U.S. PATENT DOCUMENTS

| | | | | |
|---|---|---|---|---|
| 4,906,212 | A * | 3/1990 | Mixon, Jr. | 439/857 |
| 5,352,125 | A * | 10/1994 | Banakis et al. | 439/83 |
| 5,554,056 | A | 9/1996 | Henricus op ten Berg | |
| 5,591,051 | A * | 1/1997 | Ittah | 439/752 |
| 5,951,338 | A * | 9/1999 | Seko et al. | 439/843 |
| 6,955,571 | B2 * | 10/2005 | Fujii | 439/856 |
| 2003/0236035 | A1 * | 12/2003 | Kuroda et al. | 439/857 |
| 2006/0252294 | A1 * | 11/2006 | Cvasa et al. | 439/252 |

FOREIGN PATENT DOCUMENTS

| | | |
|---|---|---|
| CN | 1127436 | 7/1996 |
| JP | 61-82378 | 5/1986 |
| JP | 07-192795 | 7/1995 |
| JP | 07-296886 | 11/1995 |
| JP | 10-055837 | 2/1998 |
| JP | 10-055846 | 2/1998 |
| JP | 2002-093508 | 3/2002 |

OTHER PUBLICATIONS

Japanese Office Action dated Oct. 21, 2010 along with an English translation of same.

Chinese Office Action dated Apr. 6, 2012 in Chinese Application No. 200910260601.5 with English translation of same.

* cited by examiner

*Primary Examiner* — Michael Zarroli
(74) *Attorney, Agent, or Firm* — Collard & Roe, P.C.

(57) ABSTRACT

A socket contact is configured to receive a part of a mating contact. The socket contact comprises a spring portion, a spring support portion and a lance. The spring portion is brought into contact with the mating contact when the socket contact receives the part of the mating contact. The spring support portion supports the spring portion. The lance is provided on the spring support portion.

14 Claims, 3 Drawing Sheets

SOCKET CONTACT

CROSS REFERENCE TO RELATED APPLICATIONS

Applicants claim priority under 35 U.S.C. §119 of Japanese Patent Application No. JP2008-332901 filed Dec. 26, 2008.

BACKGROUND OF THE INVENTION

The present invention relates to a socket contact in which a mating contact such as a pin-like contact is inserted and to a connector comprising the socket contact.

For example, a socket contact or female contact is disclosed in JP-A H7 (1995)-192795, the contents of which are incorporated herein by reference. The disclosed female contact has a pair of lances projecting obliquely rearward and a contact section that includes a pair of cantilever beams extending frontward in parallel to each other. The contact section is brought into contact with a male contact which is a mating connector to the socket contact or female contact. The socket contact is inserted into a housing and is held in the housing. Upon the insertion of the socket contact, tips of the lances are received within lance receptacle sections provided in the housing, so that the socket contact is prevented from coming off the housing.

SUMMARY OF THE INVENTION

It is an object of the present invention to provide a socket contact having a structure that prevents the socket contact from coming off a housing more reliably as compared to the prior art and a connector comprising the socket contact.

A first aspect of the present invention provides a socket contact configured to receive a part of a mating contact. The socket contact comprises a spring portion, a spring support portion and a lance. The spring portion is brought into contact with the mating contact when the socket contact receives the part of the mating contact. The spring support portion supports the spring portion. The lance is provided on the spring support portion.

A second aspect of the present invention provides a connector which comprises the aforementioned socket contact and a housing holding the socket contact therein.

An appreciation of the objectives of the present invention and a more complete understanding of its structure may be had by studying the following description of the preferred embodiment and by referring to the accompanying drawings.

Figure 1:
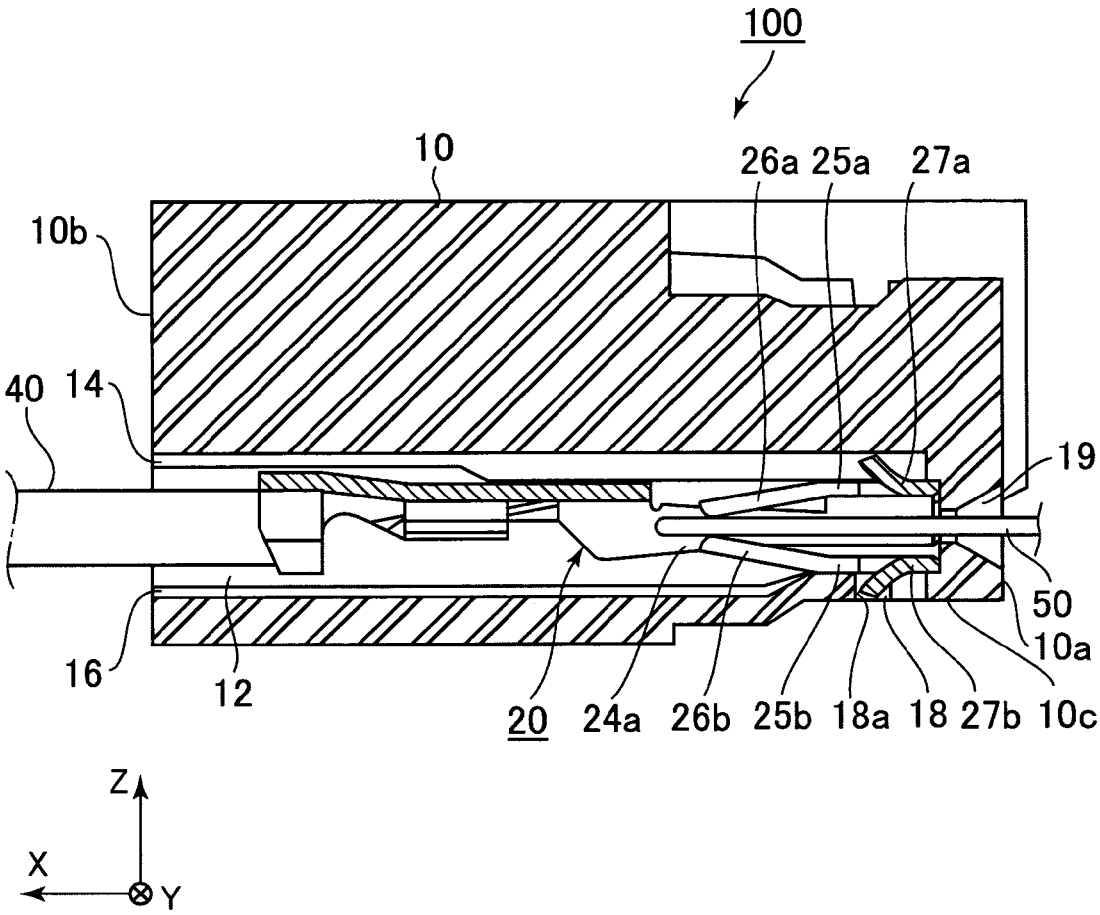
FIG. 1 is a cross-sectional view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector 100 according to an embodiment of the present invention includes a housing 10 formed of an insulating material and a socket contact 20 inserted and held in the housing 10.

The housing 10 has a retainer hole 12 defined therein. The socket contact 20 is inserted and is held in the retainer hole 12. The retainer hole 12 extends from a rear end 10*b* to a front end 10*a* of the housing 10 (in the negative direction of the X-axis (first axis)). Guide grooves 14 and 16 are respectively formed in an upper surface and a lower surface defining the retainer hole 12. Those guide grooves 14 and 16 extend in the X-axis direction. In this embodiment, the guide groove 16 is designed so that the guide groove 16 is shorter than the guide groove 14. The housing 10 includes a lance receptacle portion 18 formed in front of the guide groove 16, wherein the lance receptacle portion 18 is isolated from the guide groove 16. The lance receptacle portion 18 of this embodiment communicates with the bottom 10*c* of the housing 10 and the retainer hole 12. The housing 10 of this embodiment also includes an insertion hole 19 into which a mating contact (pin contact) 50 is inserted. The insertion hole 19 communicates with the front end 10*a* and the retainer hole 12 of the housing 10.

Figure 2:
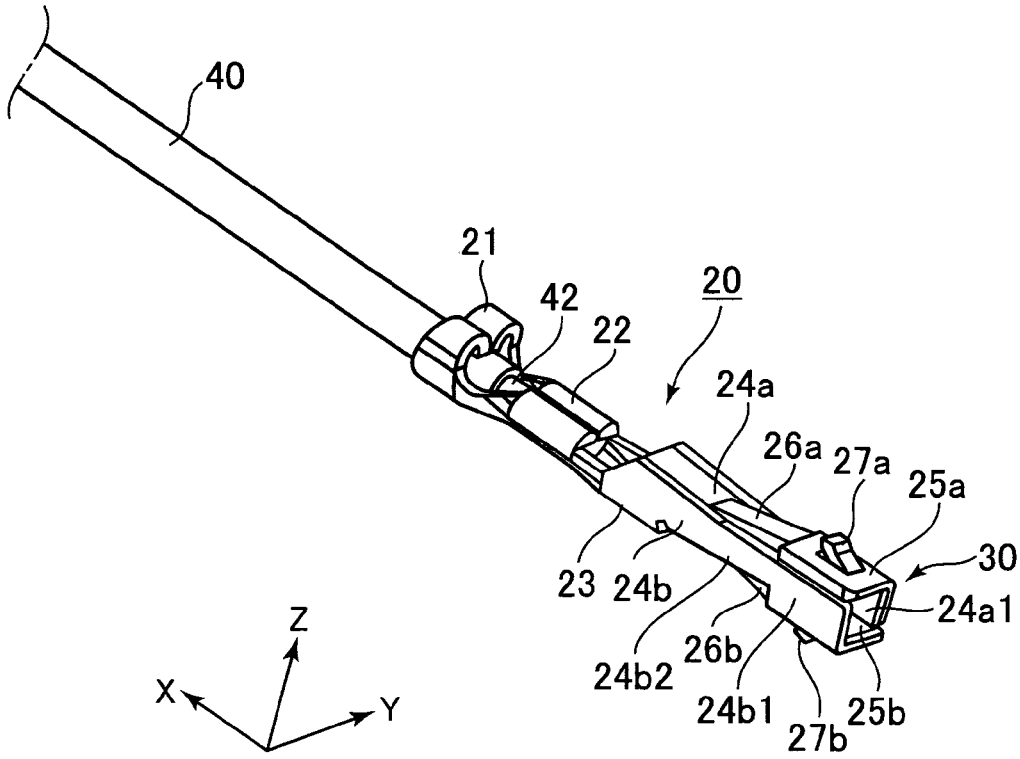
FIG. 2 is a perspective view showing a socket contact included in the connector shown in FIG. 1.
Figure 3:
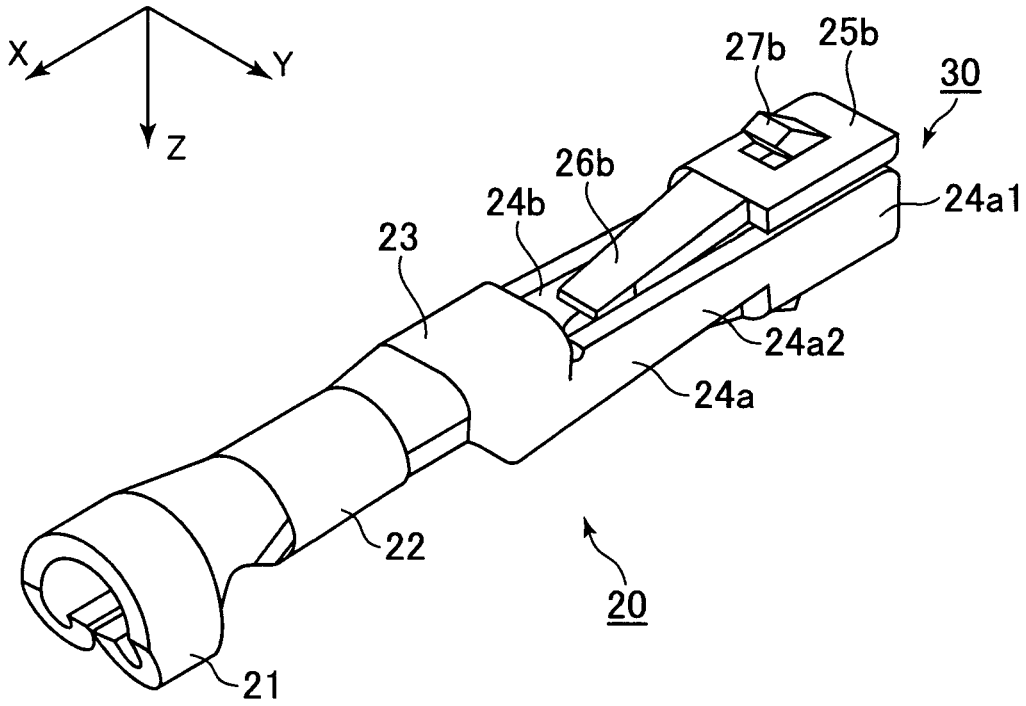
FIG. 3 is another perspective view showing the socket contact of FIG. 2.

As shown in FIGS. 1 to 3, the socket contact 20 is attached to a cable 40 and connected to a conductor portion 42 of the cable 40. The socket contact 20 of this embodiment is used to establish an electric connection between the conductor portion 42 of the cable 40 and the mating contact 50. As shown in FIGS. 2 and 3, the socket contact 20 includes a cable retainer portion 21 for holding the cable 40, a connection portion 22 provided in front of the cable retainer portion 21, an intermediate portion 23 provided in front of the connection portion 22, and a pair of arm portions 24*a* and 24*b* provided at each edge of the intermediate portion 23 in the Y-axis direction. The connection portion 22 is connected to the conductor portion 42 of the cable 40. The arm portions 24*a* and 24*b* extend in the negative direction of the X-axis. The socket contact 20 also includes a first spring support portion 25*a* provided at an end of the arm portion 24*a*, a first spring portion 26*a* supported by the first spring support portion 25*a*, and a first lance 27*a* formed on the first spring support portion 25*a*. Furthermore, the socket contact 20 also includes a second spring support portion 25*b* provided at an end of the arm portion 24*b*, a second spring portion 26*b* supported by the second spring support portion 25*b*, and a second lance 27*b* formed on the second spring support portion 25*b*. The first spring support portion 25*a* and the second spring support portion 25*b* are opposed to each other in the direction of the Z-axis (second axis).

Each of the arm portions 24*a* and 24*b* of this embodiment is in the form of a plate extending in parallel to the XZ-plane. The arm portions 24*a* and 24*b* are opposed to each other in the direction of the Y-axis (third axis). Specifically, the arm portion 24*a* comprises a tapered portion 24*a*2 and a rectangular plate portion (end portion) 24*a*1. The tapered portion 24*a*2 has a width that decreases toward the front end. The rectangular plate portion 24*a*1 is wider than an end of the tapered portion 24*a*2. The arm portion 24*b* comprises a tapered portion 24*b*2 and a rectangular plate portion (end portion) 24*b*1. The tapered portion 24*b*2 has a width that decreases toward the front end. The rectangular plate portion 24*b*1 is wider than an end of the tapered portion 24*b*2.

The first spring support portion 25*a* in this embodiment is in the form of a plate. The first spring support portion 25*a* is cantilevered at an edge of the plate portion 24*a*1 in the Z-axis direction (i.e., an upper edge) by the arm portion 24*a*. The first spring support portion 25*a* extends in the negative direction of the Y-axis. The second spring support portion 25*b* is also in the form of a plate. The second spring support portion 25*b* is cantilevered at an edge of the plate portion 24*b*1 in the Z-axis direction (i.e., a lower edge) by the arm portion 24*b*. The second spring support portion 25*b* extends in the positive direction of the Y-axis. The plate portions 24*a*1 and 24*b*1 of the arm portions 24*a* and 24*b*, the first spring support portion 25*a*, and the second spring support portion 25*b* jointly form a tip portion 30 of the socket contact 20. The tip portion 30 of this embodiment is in the form of a rectangular tube. The mating contact 50 is inserted into the tip portion 30 as described later.

As shown in FIGS. 1 and 2, the first spring portion 26*a* of this embodiment extends obliquely downward from a rear edge of the first spring support portion 25*a*. In other words, the first spring portion 26*a* extends in a direction that is oblique to both of the positive direction of the X-axis and the negative direction of the Z-axis from an edge of the first spring support portion 25*a* in the X-axis direction. Similarly, as shown in FIGS. 1 and 3, the second spring portion 26*b* extends obliquely upward from a rear edge of the second spring support portion 25*b*. In other words, the second spring portion 26*b* extends in a direction that is oblique to both of the positive direction of the X-axis and the positive direction of the Z-axis from an edge of the second spring support portion 25*b* in the X-axis direction. Accordingly, as best illustrated in FIG. 1, the spring portions 26*a* and 26*b* of this embodiment are arranged so that a distance between those spring portions 26*a* and 26*b* increases toward the tip portion 30. The distance between free ends of the first spring portion 26*a* and the second spring portion 26*b* is designed so as to be less than the thickness of the mating contact 50 in the Z-axis direction.

As shown in FIGS. 1 and 2, the first lance 27*a* of this embodiment is formed by processing a portion of the first spring support portion 25*a*. The first lance 27*a* extends obliquely upward (in a direction that is oblique to both of the positive direction of the X-axis and the positive direction of the Z-axis) from the first spring support portion 25*a*. Thus, the first lance 27*a* differs from the first spring portion 26*a* in that the first lance 27*a* extends obliquely upward while the first spring portion 26*a* extends obliquely downward. In other words, the first lance 27*a* and the first spring portion 26*a* corresponding thereto are directed to a common orientation to each other on the X-axis, while being directed to opposite orientations to each other on the Z-axis. In this embodiment, the first spring support portion 25*a* is cantilevered by the arm portion 24*a*. Accordingly, when a force is applied along the positive direction of the Z-axis to the first spring portion 26*a* (an upward force is applied to the first spring portion 26*a*), the first lance 27*a* is pressed upward (along the positive direction of the Z-axis) by the force applied to the first spring portion 26*a*.

As shown in FIGS. 1 and 3, the second lance 27*b* of this embodiment is formed by processing a portion of the second spring support portion 25*b*. The second lance 27*b* extends obliquely downward (in a direction that is oblique to both of the positive direction of the X-axis and the negative direction of the Z-axis) from the second spring support portion 25*b*. Thus, the second lance 27*b* differs from the second spring portion 26*b* in that the second lance 27*b* extends obliquely downward while the second spring portion 26*b* extends obliquely upward. In other words, the second lance 27*b* and the second spring portion 26*b* corresponding thereto are directed to a common orientation to each other on the X-axis, while being directed to opposite orientations to each other on the Z-axis. As best illustrated in FIG. 1, the first lance 27*a* and the second lance 27*b* are arranged so that a distance between those lances 27*a* and 27*b* increases toward the rear end. In this embodiment, the second spring support portion 25*b* is cantilevered by the arm portion 24*b*. Accordingly, when a force is applied along the negative direction of the Z-axis to the second spring portion 26*b* (a downward force is applied to the second spring portion 26*b*), the second lance 27*b* is pressed downward (along the negative direction of the Z-axis) by the force applied to the second spring portion 26*b*.

As can be seen from FIG. 1, the socket contact 20 is inserted into the retainer hole 12 from the rear end 10*b* toward the front end 10*a* of the housing 10. Upon the insertion, the first lance 27*a* and the second lance 27*b* are respectively guided by the guide grooves 14 and 16 formed in the housing 10. In this embodiment, the first lance 27*a* and the second lance 27*b* are provided on the tip portion 30 of the socket contact 20. Therefore, when the socket contact 20 is inserted into the retainer hole 12 of the housing 10, it is guided from the beginning of the insertion operation. Thus, according to this embodiment, deformation of the socket contact 20 is prevented from being caused by erroneous insertion. Meanwhile, two lances of the first lance 27*a* and the second lance 27*b* are provided in this embodiment. Therefore, the socket contact 20 can be inserted into the retainer hole 12 even if it is turned upside down.

When the socket contact 20 has fully been inserted in the retainer hole 12, a tip of the second lance 27*b* is received within the lance receptacle portion 18. If a rearward force is applied (in the X-axis direction) to the socket contact 20 in that state, then the tip of the second lance 27*b* is brought into abutment against a rear wall 18*a* in the lance receptacle portion 18. Accordingly, the socket contact 20 is prevented from coming off the retainer hole 12. In this embodiment, this function of the second lance 27*b* is enhanced by the second spring portion 26*b*. Specifically, when the mating contact 50 is being inserted into the socket contact 20 through the insertion hole 19 and the tip portion 30 of the socket contact 20, the first spring portion 26*a* and the second spring portion 26*b* of the socket contact 20 receive forces from the mating contact 50 such that they are separated from each other. That is, when the mating contact 50 is inserted, the first spring portion 26*a* and the second spring portion 26*b* receive forces directing outward on the Z-axis (i.e., an upward force and a downward force, respectively) and thus spread outward. Those forces are respectively transmitted to the first lance 27*a* and the second lance 27*b* through the first spring support portion 25*a* and the second spring support portion 25*b*, so that the first lance 27*a* and the second lance 27*b* also receive forces such that they spread outward (they are separated from each other). Thus, even if an attempt to move the socket contact 20 rearward is made in a state where the mating contact 50 is inserted in the socket contact 20, the socket contact 20 is reliably prevented from coming off the retainer hole 12 because the tip of the second lance 27*b* is held in reliable abutment against the rear wall 18*a* of the lance receptacle portion 18.

While the lance receptacle portion 18 is provided only on a lower side of the retainer hole 12 in the housing 10 according to this embodiment, a lance receptacle portion may be provided on an upper side of the retainer hole 12. Nevertheless, it is preferable to form the lance receptacle portion 18 only on the lower side of the retainer hole 12 as in this embodiment because the connector is readily manufactured or intentional removal of the socket contact 20 from the housing 10 is facilitated.

In this embodiment, the tip portion 30 has the rectangular tube-like shape. Nevertheless, the tip portion 30 may have a cylindrical form or other forms.

The present application is based on a Japanese patent application of JP2008-332901 filed before the Japan Patent Office on Dec. 26, 2008, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A socket contact configured to receive a part of a mating contact, the socket contact comprising:

a spring portion which is brought into contact with the mating contact when the socket contact receives the part of the mating contact;

a spring support portion supporting the spring portion;

a lance which is provided on the spring support portion;

a tip portion which has a rectangular tube-like shape and into which the part of the mating contact is inserted along a first axis, wherein the spring support portion has a plate-like shape which is arranged perpendicular to a second axis perpendicular to the first axis and is formed as a part of the tip portion;

an intermediate portion; and a pair of arm portions opposed to each other in a third axis perpendicular to the first and the second axes, each of the arm portions having an end portion constituting a part of the tip portion, each of the arm portions extending from the intermediate portion to the end portion;

wherein:

the reception of the part of the mating contact by the socket contact is carried out along the first axis;

upon the contact of the spring portion with the mating contact, the spring portion is applied with a force by the mating contact along the second axis; and the lance is pressed by the force along the second axis.

2. The socket contact claimed in claim 1, wherein the lance extends obliquely to the first axis and to the second axis.

3. The socket contact claimed in claim 2, wherein the spring portion and the lance are directed to a common orientation to each other on the first axis but are directed to opposite orientations to each other on the second axis.

4. The socket contact claimed in claim 1, wherein the spring support portion is cantilevered on the end portion of one of the arm portions and extends from the end portion along the third axis.

5. A connector comprising a housing and a socket contact held by the housing, the socket contact being configured to receive a part of a mating contact, the socket contact comprising:

a spring portion which is brought into contact with the mating contact when the socket contact receives the part of the mating contact;

a spring support portion supporting the spring portion;

a lance which is provided on the spring support portion;

a tip portion which has a rectangular tube-like shape and into which the part of the mating contact is inserted along a first axis, the spring support portion having a plate-like shape which is arranged perpendicular to a second axis perpendicular to the first axis and is formed as a part of the tip portion;

an intermediate portion; and a pair of arm portions opposed to each other in a third axis perpendicular to the first and the second axes, each of the arm portions having an end portion constituting a part of the tip portion, each of the arm portions extending from the intermediate portion to the end portion;

wherein:

the reception of the part of the mating contact by the socket contact is carried out along the first axis;

upon the contact of the spring portion with the mating contact, the spring portion is applied with a force by the mating contact along the second axis; and the lance is pressed by the force along the second axis.

6. The connector claimed in claim 5, wherein the lance extends obliquely to the first axis and to the second axis.

7. The connector claimed in claim 6, wherein the spring portion and the lance are directed to a common orientation to each other on the first axis but are directed to opposite orientations to each other on the second axis.

8. The connector claimed in claim 5, wherein the spring support portion is cantilevered on the end portion of one of the arm portions and extends from end portion along the third axis.

9. A socket contact configured to receive a part of a mating contact, wherein the reception of the part of the mating contact by the socket contact is carried out along a first axis, the socket contact comprising:

a spring portion which is brought into contact with the mating contact when the socket contact receives the part of the mating contact, wherein upon the contact of the spring portion with the mating contact, the spring portion is applied with a force by the mating contact along a second axis perpendicular to the first axis;

a spring support portion supporting the spring portion;

a lance which is provided on the spring support portion and is pressed by the force along the second axis;

an additional spring support portion opposed to the spring support portion in the second axis;

an additional spring portion which is supported by the additional spring support portion and is brought into contact with the mating contact when the socket contact receives the part of the mating contact, the additional spring portion being applied with an additional force by the mating contact along the second axis upon the contact of the additional spring portion with the mating contact, the additional force being opposed to the force applied to the spring portion in the second axis; and an additional lance provided on the second spring support portion so that the additional lance is pressed by the additional force.

10. The socket contact claimed in claim 9, further comprising a tip portion which has a rectangular tube-like shape and into which the part of the mating contact is inserted along the first axis, wherein each of the spring support portion and the additional spring support portion has a plate-like shape which is arranged perpendicular to the second axis and is formed as a part of the tip portion.

11. The socket contact claimed in claim 10, wherein the spring portion and the additional spring portion are arranged so that a distance between the spring portion and the additional spring portion increases toward the tip portion.

12. A connector comprising a housing and a socket contact held by the housing, the socket contact being configured to receive a part of a mating contact, wherein the reception of the part of the mating contact by the socket contact is carried out along a first axis, the socket contact comprising:

a spring portion which is brought into contact with the mating contact when the socket contact receives the part of the mating contact, wherein upon the contact of the spring portion with the mating contact, the spring portion is applied with a force by the mating contact along a second axis perpendicular to the first axis;

a spring support portion supporting the spring portion;

a lance which is provided on the spring support portion, wherein the lance is pressed by the force along the second axis;

an additional spring support portion opposed to the spring support portion in the second axis;

an additional spring portion which is supported by the additional spring support portion and is brought into contact with the mating contact when the socket contact receives the part of the mating contact, the additional spring portion being applied with an additional force by the mating contact along the second axis upon the contact of the additional spring portion with the mating contact, the additional force being opposed to the force applied to the spring portion in the second axis; and an additional lance provided on the second spring support portion so that the additional lance is pressed by the additional force.

13. The connector claimed in claim 12, wherein:

the socket contact further comprises a tip portion which has a rectangular tube-like shape and into which the part of the mating contact is inserted along the first axis; and each of the spring support portion and the additional spring support portion has a plate-like shape which is arranged perpendicular to the second axis and is formed as a part of the tip portion.

14. The connector claimed in claim 13, wherein the spring portion and the additional spring portion are arranged so that a distance between the spring portion and the additional spring portion increases toward the tip portion.

* * * * *